United States Patent [19]

Reh

[11] Patent Number: 4,506,989

[45] Date of Patent: Mar. 26, 1985

[54] VORTEX MIXER

[76] Inventor: Carter K. Reh, 13312 Loretta Dr., Santa Ana, Calif. 92705

[21] Appl. No.: 613,074

[22] Filed: May 22, 1984

[51] Int. Cl.[3] ..... B01F 7/22

[52] U.S. Cl. ..... 366/270; 366/286; 366/305; 366/330; 415/140

[58] Field of Search ..... 366/64, 65, 244, 245, 366/253, 254, 264, 270, 279, 285, 286, 302, 305, 330, 331; 415/131, 140; 416/128, 131, 161, 164, 189 R, 195, 196 A, 225

[56] References Cited

U.S. PATENT DOCUMENTS

| | | | |
|---|---|---|---|
| 687,182 | 11/1901 | Franklin | 366/285 |
| 780,926 | 1/1905 | Welds | 366/286 |
| 920,489 | 5/1909 | McIntosh | 415/140 |
| 940,099 | 11/1909 | Welds | 366/286 |
| 1,752,366 | 4/1930 | Brown | 415/140 |
| 2,016,647 | 10/1935 | McMartin | 366/270 |
| 3,973,759 | 8/1976 | Mizrahi et al. | 366/264 |

*Primary Examiner*—Robert W. Jenkins
*Assistant Examiner*—Arthur D. Dahlberg
*Attorney, Agent, or Firm*—Robert E. Strauss

[57] ABSTRACT

There is disclosed a mixer ideally suited for mixing of viscous, pasty and semi-solid materials. The mixer comprises at least one propeller having a central hub fixedly secured to the drive shaft and a plurality of axially pitched, radial blades carried by the hub. Preferably the blades terminate in an outer, annular thin rim. The propeller is used in an assembly which includes a stator that is supported by a spider having a second hub that is slideably and rotatably received over the drive shaft and that supports a plurality of arms which surround the propeller. A second plurality of axially pitched, radial blades are carried by the second hub, preferably of equal number and substantially the same configuration as the first plurality of blades of the propeller. These blades are centrally supported by a third hub which is also slideably and rotatably received over the drive shaft and the blades preferably terminate in a second, outer, annular thin rim which is also attached to the arms of the spider. Preferably these arms extend slightly below the lowermost stator blades to provide feet for resting the stator spider assembly on the bottom surface of the container with which the mixer is used.

11 Claims, 6 Drawing Figures

VORTEX MIXER

BACKGROUND OF THE INVENTION

1. Field of Invention

This invention relates to a mixer and, in particular, to a mixer providing high shear mixing of pasty, semi-solid materials.

2. Brief Statement Of The Prior Art

High shear mixers and blenders have been provided with sets of rotating and stationary blades. U.S. Pat. No. 3,709,664 discloses such an arrangement in which the stator blades are secured to the inner walls of the vessel. Household egg beaters are an illustration of portable mixers having stator blades closely positioned to propeller blades, such as those shown in U.S. Pat. Nos. 2,121,918 and 2,149,104. Household blenders also have been provided with high speed rotating blades in close proximity to sets of stator blades, such as in U.S. Pat. Nos. 3,499,633 and 3,197,181. The stator blades can also be rotated in an opposite rotational direction such as in U.S. Pat. No. 2,231,926 which shows counter-rotating blades or U.S. Pat. No. 4,190,371 which discloses a rotor driven at high rotational speed and a stator driven in the same direction but at much lower rotational speeds.

All of the aforementioned devices are relatively complex and are intended for very specific mixing or blending applications. Chunks of material or large particles and the like can become jammed between the rotor and stator blades and none of the devices have provisions for unloading these obstructions without removing, and in many cases dismantling, the mixing assembly.

BRIEF DESCRIPTION OF THE INVENTION

This invention comprises a mixer for use with thick, pasty,semi-solid liquids which has a high tolerance to large particles, agglomerates, etc. The mixer comprises an assembly of a propeller having a central hub fixedly secured to a drive shaft with a plurality of axially pitched, radially extending blades. Preferably the blades terminate in attachment to an outer, annular, thin rim. The propeller is surrounded by a cage formed of a stator spider which as an upper central hub that is slideably and rotatably received over the drive shaft and that supports a plurality of outwardly extending arms which project past the propeller and are attached at their opposite ends to a second annular thin rim. The second rim is in a sub-assembly of a stator having a central hub that is slideably and rotatably received over the drive shaft and that supports a plurality of axially pitched, radially extending stator blades. The outer tips of the stator blades are attached to the second annular rim. Preferably, the spider arms extend slightly below the bottom edge of the second annular rim to provide feet for the spider which can be rested against the bottom wall of the vessel in which the mixer is employed.

BRIEF DESCRIPTION OF THE DRAWINGS

The invention will be described with reference to the FIGURES of which.

DESCRIPTION OF PREFERRED EMBODIMENTS

Figure 1:
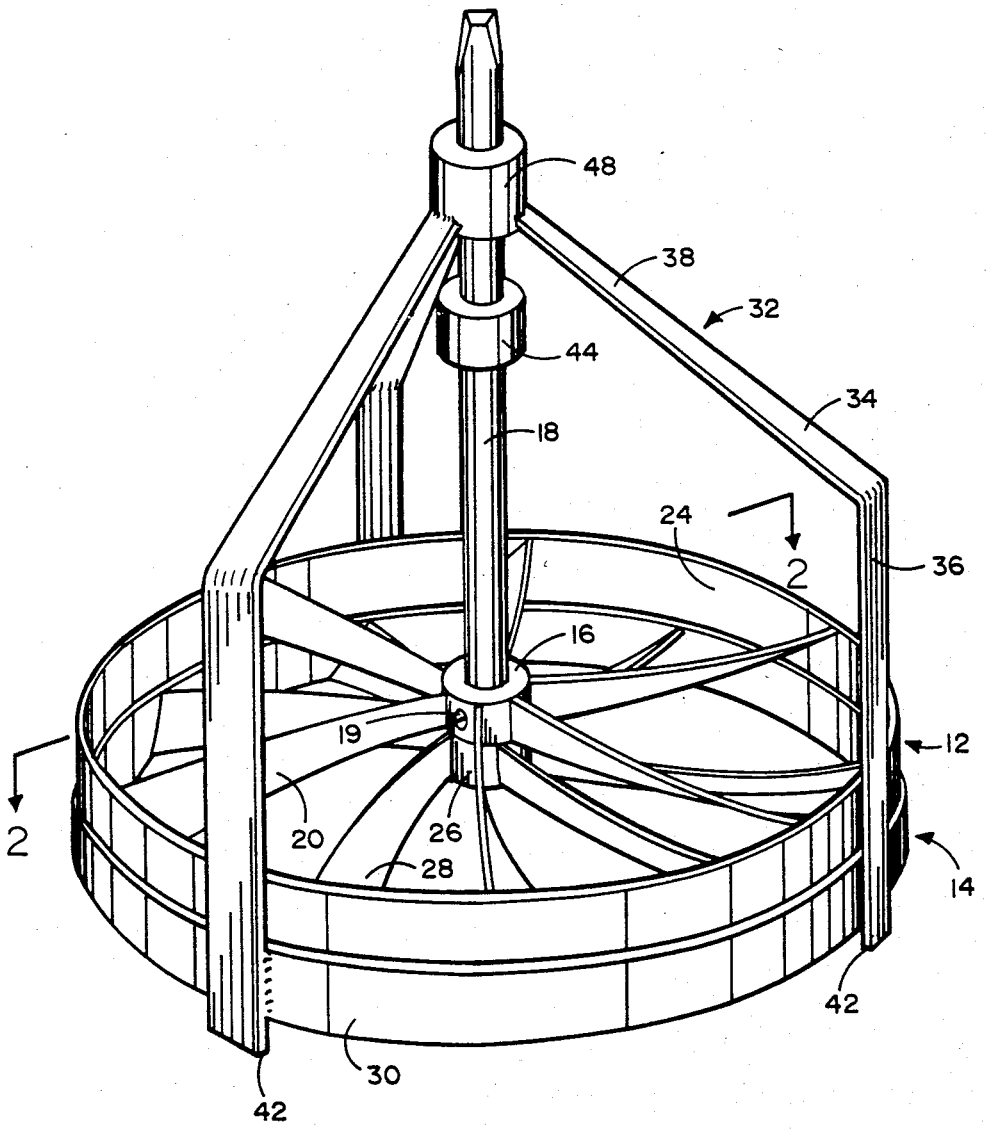
FIG. 1 is a perspective view of the mixer.

Referring now to FIG. 1, the mixer 10 is an assembly of a propeller subassembly 12 having a central hub 16 which is fixedly secured to drive shaft 18. This can be a permanent attachment, e.g., by welding, or can be an adjustable attachment such as by use of set screw 19 which is received in a threaded bore in hub 16 and which bears against a flat (not shown) on shaft 18. The propeller includes a plurality of axially pitched, radially extending blades 20. Preferably, each blade has a helical twist, as illustrated, to provide the axial pitch. The blades 20 terminate at their outer ends 22 in attachment to an outer annular, thin rim 24.

The stator subassembly 14 is formed of a stator stage including a hub 26 that is slideably and rotatably received over the lower end of shaft 18 with a plurality of blades 28 which extend radially outwardly from the hub 26 and are fixedly secured thereto. Preferably a like number of blades 28 are used in both the stator 14 and the rotor 12. Also the blades 28 preferably have the same helical curvature as blades 20 in the rotor section 12. The outer tips of blades 28 are fixedly secured to a second annular, thin ring 30.

The stator section 14 also includes a spider frame 32 which is formed with a plurality of legs 34 which have a longitudinal section 36 extending axially with shaft 18. The lower end of each leg 34 extends a slight distance past the lower edge of the stator ring 30 to form feet 42. The upper section 38 of each of the blades is bent inwardly at approximately 45 degrees to the vertical and this inclined leg section 38 of each of the legs terminates in a permanent attachment to another central hub 48 which is also slideably and rotatably received over shaft 18. The upper end of shaft 18 extends a slight distance above the upper hub 48 for attachment to a rotational driver (not shown), e.g., the chuck of a hand drill, a V-belt pulley, or direct coupling to a motor drive or to a gear train, etc.

Preferably, an axial stop in the form of a hub 44 is fixedly secured to shaft 18, by permanent means or, if desired, by adjustable means such as a set screw and the like. This axial stop 44 serves to limit the maximum vertical separation between the rotor 12 and the stator 14.

Figure 2:
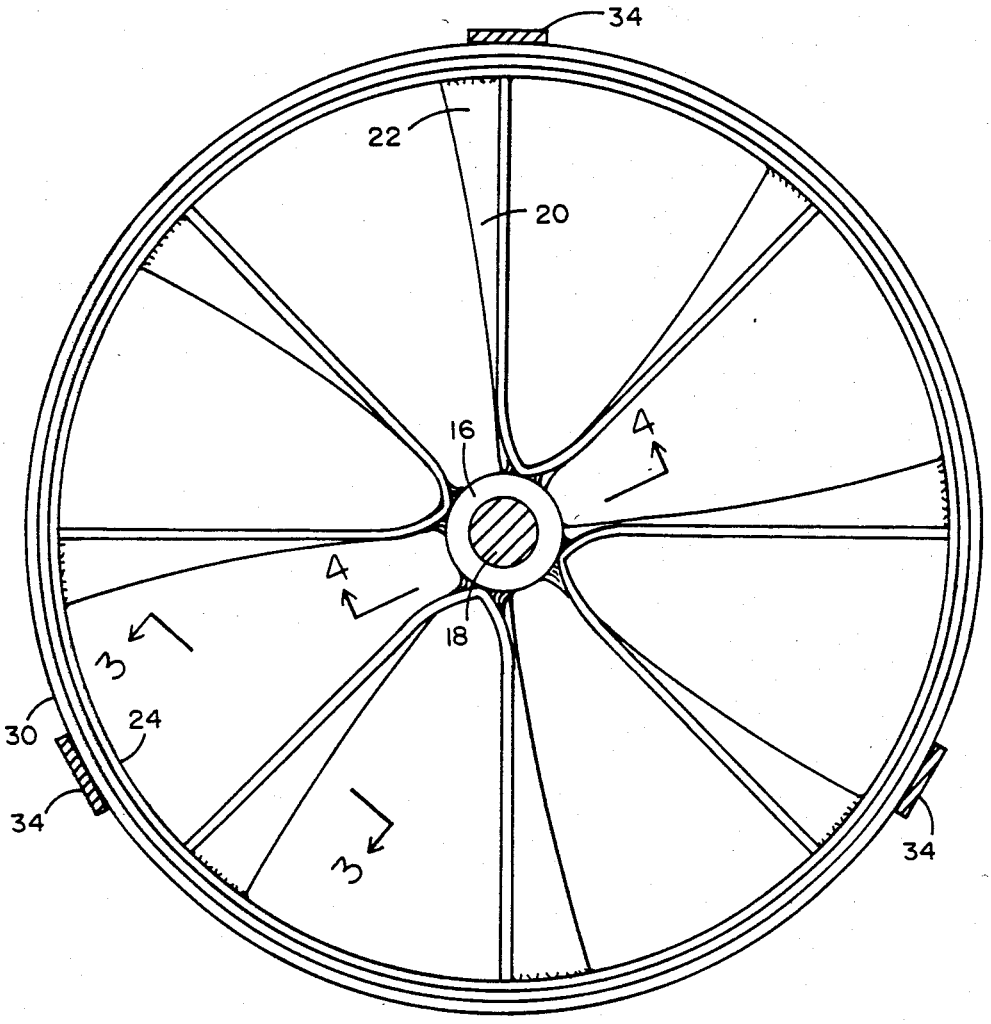
FIG. 2 is a view along lines 2—2 of FIG. 1.

Referring now to FIG. 2, the structure of the mixer will be described in greater detail. As shown in FIG. 2, the annular, thin rim 24 of the rotor 12 is of slightly lesser diameter than that of the stator rim 30. This insures that the rotor rim 24 does not rub against the inside walls of the legs 36. Additionally, the continuous helical twist of the blades 20 and 28 of the rotor 12 and stator 14 is apparent from FIG. 2.

Figure 3:
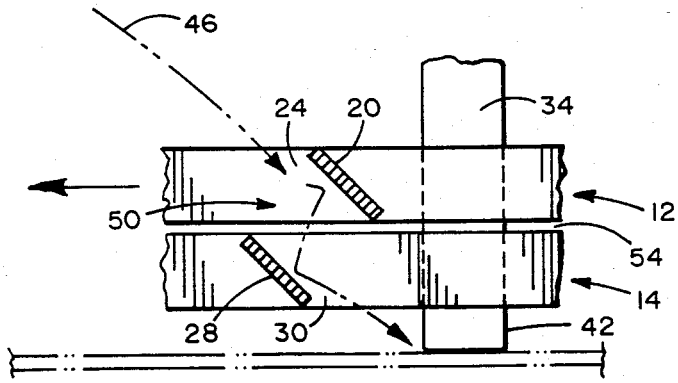
FIG. 3 is a view along lines 3—3 of FIG. 2.

Referring now to FIG. 3, there is illustrated a sectional view through the blades 20 of the rotor stage 12 and blades 28 of the stator stage 14. During the operation, the rotor stage 12 is rotated at relatively high rotational speeds, e.g., from about 50 to about 2500, preferably from 50 to about 1500, revolutions per minute. The stator blades are retarded in rotation, preferably by resting the feet 42 of legs 36 on the bottom surface of the containing vessel in which the mixer is employed. The viscous liquid material is dragged into the space 50 between the super-imposed blades 20 and 28 (shown by phantom arrowhead line 46) and is sheared between these blades.

Figure 4:
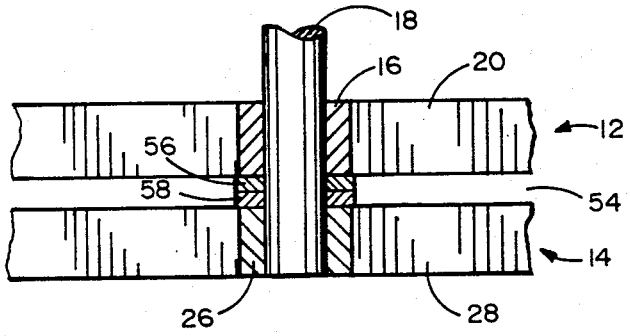
FIG. 4 is a view along lines 4—4 of FIG. 2.

The spacing 54 between the rotor 12 and the stator 14 can be varied as desired. That spacing is shown at a minimal value in FIG. 3. Refering now to FIG. 4, there is illustrated an embodiment in which the spacing between the rotor 12 and stator 14 has been increased over that shown in FIG. 3. As shown in FIG. 4, a number of washers 56 and 58 are placed between the hubs 16 and 26 to provide a greater vertical clearance 62 between the rotor 12 and stator 14.

One of the difficulties experienced with high shear mixing devices having rotor and stator stages is the tendency for these devices to become jammed with solid particles and agglomerates which may be present in the liquid undergoing treatment. With the device of this invention, however, the obstructions do not jam the mixer but, instead, any obstructions which are encountered between the rotor and stator stages are quickly dislodged or unloaded. This is achieved in the manner illustrated in FIGS. 5 and 6.

Figure 5:
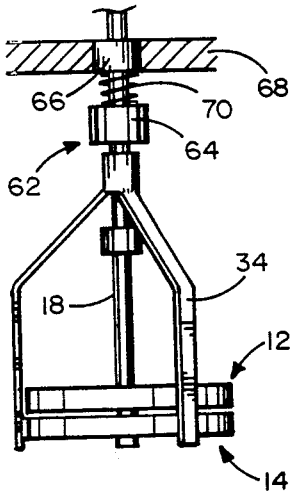
FIG. 5 is an elevational view of the mixer in normal operation.

As shown in FIG. 5, there is a typical application of the mixer in which the shaft 18 is mounted in a suitable rotary drive device such as a chuck 62 with an annular drive pulley 64. The shaft 18 extends upwardly into a sliding fit in journal 66 mounted in the abuttment wall 68. The rotor 12 is resiliently biased downwardly by a suitable means such as the compression coil spring 70 mounted between a spring retainer (not shown) on shaft 18 and the abuttment wall 68. FIG. 5 illustrates the mixer in its normal operation with a close spacing 54 between the rotor 12 and stator 14.

Figure 6:
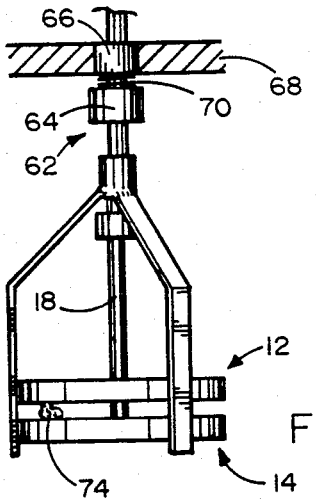
FIG. 6 is a view of the mixer encountering large particles or agglomerates during the mixing operation.

In the event that a solid particle is captured between the adjacent blades of the rotor and stator stages, the mixer responds in the manner illustrated in FIG. 6. As there illustrated, the solid particle 74 wedged between the blade of the stator 14 and a blade 20 of the rotor 12, the rotor 12 will separate from the stator 14, with the wedging force overcoming the compression force of spring 70. The result is to lift the rotor 12 until it clears the solid particle 74, which is dislodged from the mixer. Once the solid particle 74 is dislodged, the rotor 12 is urged into close spacing with the stator section 14 by coil spring 70, and the mixer continues an efficient mixing and shearing of the liquid.

The invention has been described with reference to the illustrated and presently preferred embodiment. It is not intended that the invention be unduly limited by this disclosure of the illustrated and presently preferred embodiment. Instead, the invention is intended to be defined by the means, and their obvious equivalents, set forth in the following claims:

What is claimed is:

1. A mixer comprising:

(a) a rotatable propeller subassembly comprising:
  (i) a central, power shaft having one end for engagement with a rotational drive; and
  (ii) at least one propeller carried on said shaft with a first hub and a plurality of axially pitched radial blades carried thereon and fixedly secured to said shaft at an axial position along its length;

(b) a stator and stator spider subassembly comprising:
  (i) a central hub slidably and rotationally received on said shaft;
  (ii) a second plurality of axially pitched blades carried by said second hub;
  (iii) a cylindrical rim surrounding and fixedly secured to the outer tips of the blades of said second plurality of blades;
  (iv) a third hub slidably and rotationally received on said shaft; and
  (v) a plurality of arms fixedly interconnected between said third hub and said cylindrical rim.

2. The mixer of claim 1 including a sleeve fixed secured to said shaft between said third hub and said propeller subassembly to limit the axial displacement between said propeller and stator subassemblies.

3. The mixer of claim 2 wherein each of said plurality of arms has an inclined radial leg and an axial leg.

4. The mixer of claim 2 wherein each of said plurality of arms projects a slight distance past the lower edge of said rim to provide feet to rest on the bottom wall of a vessel.

5. The mixer of claim 1 wherein each blade of said first plurality of blades has a helical pitch.

6. The mixer of claim 1 wherein each blade of said second plurality of blades has a helical pitch.

7. The mixer of claim 1 in combination with drive means including chuck means retaining said shaft and resilient means biasing said propeller subassembly towards said stator subassembly.

8. The mixer of claim 7 wherein said resilient means comprises a compression spring received over the upper end of said drive shaft and biased against an abutment stop and said chuck means.

9. The mixer of claim 8 wherein said drive shaft extends through said second central hub a sufficient distance to provide a predetermined axial displacement of said propeller subassembly relative to said stator assembly.

10. The mixer of claim 9 also including a sleeve received over said shaft and fixed secured thereto subjacent to said third hub to serve as a stop to limit the axial displacement of said propeller subassembly.

11. The mixer of claim 1 including a second rim surrounding and fixedly secured to the outer tips of the blades of said first propeller.

* * * * *